US006818101B2

(12) United States Patent
Vinson et al.

(10) Patent No.: US 6,818,101 B2
(45) Date of Patent: Nov. 16, 2004

(54) TISSUE WEB PRODUCT HAVING BOTH FUGITIVE WET STRENGTH AND A FIBER FLEXIBILIZING COMPOUND

(75) Inventors: Kenneth Douglas Vinson, Cincinnati, OH (US); Paul Joseph Coffaro, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 51 days.

(21) Appl. No.: 10/302,228

(22) Filed: Nov. 22, 2002

(65) Prior Publication Data

US 2004/0099387 A1 May 27, 2004

(51) Int. Cl.[7] ..... D21H 17/06; D21H 21/11; D21F 11/00

(52) U.S. Cl. ..... 162/158; 162/111; 162/112; 162/115; 162/116; 162/117; 162/123; 162/173; 162/181.2; 162/184; 428/153; 428/154

(58) Field of Search ..... 162/100, 109–117, 162/123, 124, 135, 158, 164.1, 166, 167, 173, 175, 179, 180, 183–186, 202, 204; 427/421, 424; 428/152–154

(56) References Cited

U.S. PATENT DOCUMENTS

| | | | | | |
|---|---|---|---|---|---|
| 4,514,345 | A | * | 4/1985 | Johnson et al. | 264/425 |
| 4,528,239 | A | * | 7/1985 | Trokhan | 442/33 |
| 4,529,480 | A | | 7/1985 | Trokhan | |
| 5,217,576 | A | * | 6/1993 | Van Phan | 162/158 |
| 5,449,551 | A | * | 9/1995 | Taniguchi | 442/102 |
| 5,628,876 | A | * | 5/1997 | Ayers et al. | 162/358.2 |
| 5,785,813 | A | * | 7/1998 | Smith et al. | 162/158 |
| 5,935,384 | A | | 8/1999 | Taniguchi | |
| 6,059,928 | A | * | 5/2000 | Van Luu et al. | 162/111 |
| 6,132,557 | A | * | 10/2000 | Takeuchi et al. | 162/141 |
| 6,162,329 | A | | 12/2000 | Vinson et al. | |
| 6,306,408 | B1 | | 10/2001 | Eichhorn et al. | |
| 6,468,392 | B2 | * | 10/2002 | Oriarian et al. | 162/109 |

FOREIGN PATENT DOCUMENTS

| | | |
|---|---|---|
| EP | 0 617 164 B1 | 9/1994 |
| EP | 0 677 612 B1 | 10/1995 |
| EP | 0 688 901 B1 | 10/1999 |
| JP | 5-156596 | 6/1993 |
| JP | 7-216786 | 8/1995 |
| JP | 2001-262489 | 9/2001 |
| WO | WO 01/38638 A1 | 5/2001 |

* cited by examiner

*Primary Examiner*—Steven P. Griffin
*Assistant Examiner*—Eric Hug
(74) *Attorney, Agent, or Firm*—C. Brant Cook; Vladimir Vitenberg; David M. Weirich

(57) ABSTRACT

A tissue product comprising cellulosic fibers and having at least 10% of fugitive wet strength and at least about 3% of a fiber-flexibilizing composition. The fugitive wet strength can be generated by adding a binder that promotes acid-catalyzed formation of hemiacetal functional inter-fiber cross-links. The fiber-flexibilizing composition can comprise either a humectant or a plasticizer. The humectant can be selected from the group consisting of calcium chloride; lactic acid and its salts, high fructose corn syrup, glycerol, triacetin, sorbitol, maltitol, mannitol, propylene glycol, and any combination thereof. The plasticizer can be selected from the group consisting of urea, alkyloxylated glycols, dextrose, sucrose, ethylene carbonate, propylene carbonate, and any combination thereof.

19 Claims, 3 Drawing Sheets

TISSUE WEB PRODUCT HAVING BOTH FUGITIVE WET STRENGTH AND A FIBER FLEXIBILIZING COMPOUND

TECHNICAL FIELD

This invention relates, in general, to softening tissue product having fugitive wet strength properties; and more specifically, to a composition which may be applied to such tissue product for enhancing the softness thereof.

BACKGROUND OF THE INVENTION

Sanitary paper tissue products are widely used. Such items are commercially offered in formats tailored for a variety of uses including facial tissues, toilet tissues and absorbent towels. Providing softness in such tissue and toweling products so as to allow comfortable cleaning without performance impairing sacrifices has long been the goal of the engineers and scientists who are devoted to research into improving tissue paper. Softness is a complex tactile impression evoked by a product when it is stroked against the skin. Softness has components arising from surface (fuzziness) properties as well as bulk (flexibility) properties.

There have been numerous attempts to improve the softness of tissue products. One area that has been exploited in this regard has been to engineer paper structures to take optimum advantages of the various available morphologies. U.S. Pat. No. 4,300,981, issued Nov. 17, 1981, discusses how fibers can be directed into various layers to be compliant to paper structures so that they have maximum softness delivery. While such techniques improve softness by the surface mechanism by generating more free fibers extending from the surface of the tissue, sometimes referred to as "free fiber ends" or "fuzz on edge" properties, they unfortunately are often accompanied by a tendency of the tissue product to release fibers from its surface, a property referred to herein as "lint".

Another area receiving a considerable amount of attention is the addition of chemical softening agents, or "chemical softeners," to tissue and toweling products. As used herein, the term "chemical softeners" refers to chemical ingredients that improve the softness of the tissue web to which they are applied. Chemical softeners impart a lubricious feel to tissue. As an example, they may include basic waxes such as paraffin and beeswax, and oils such as mineral oil and silicone oil as well as petrolatum, and more complex lubricants and emollients such as quaternary ammonium compounds with long alkyl chains, functional silicones, fatty acids, fatty alcohols and fatty esters.

Typically, chemical softeners are added in small amounts, less than about 5%, and generally less than 1%. One of the reasons for using such small amounts is a relatively high cost of the softeners compared to other papermaking ingredients. Another reason is that the chemical softeners, particularly when added prior to web drying or during web drying, may cause loss of paper strength and loss of adhesion of the paper sheet as it is creped from the Yankee dryer. Even if added after the web is formed, dried, (and creped if applicable) such as described, for example, in U.S. Pat. No. 6,162,329 the softeners may still cause some undesirable consequences, such as strength degradation and the capacity of the tissue web surface for holding such additives, and the specific degradation of the surface strength, which, in turn, raises the before-mentioned problem of "lint."

The benefits of adding fiber-flexibilizing compounds to a tissue paper have also been recognized in the art. The fiber-flexibilizing compounds can be classified into (a) "humectants," defined herein as ingredients which raise the equilibrium moisture content in excess of that of the base paper to which they are applied, typically cellulosic in nature, and (b) "plasticizers," defined herein as compounds which do not themselves result in an equilibration to a particularly high moisture content with humidity, nonetheless, their intrinsic molecular properties emulate the effect on fibers similar to that observed as the moisture content is raised. In other words, plasticizers have the effect of making fibers flaccid without substantially raising the moisture content of the fibers. Applicants recognize that a compound classified as a humectant can, and typically does, intrinsically possess plasticizer properties itself, i.e. capability to plasticize fibers beyond a level expected due to the moisture which it is able to attract and/or retain within the fiber.

Despite the recognized advantages of the fiber-flexibilizing compositions, their utility with respect to paper softening has been limited primarily because (a) the amount of the composition needs to be limited due to deposition methods requiring either wet-end addition or press-section addition, i.e. so-called "wet-web" addition methods; and (b) the need to provide a so-called fugitive wet strength in the products most desiring the flexibilizing treatment.

It is important for certain tissue papers, especially those which will be disposed through sewer and septic systems, to have fugitive wet strength. Fugitive wet strength is defined herein as the percentage of wet tensile strength reduction observed when measured about 30 minutes after wetting, compared to that measured immediately upon wetting. Fugitive wet strength is typically induced by providing ketone or aldehyde functional groups in the cellulose or in an additive to the cellulose fibers so that inter-fiber acid-catalyzed hemiacetal bond formation can occur. These chemical bonds are initially resistant to breakage even when wetted, but slowly lose such resistance to hydrolysis in water such that the wet tensile strength decays with time. Thus, the fugitive wet strength permits delivery of a product having a high initial wet tensile strength so that it can be used in a moist condition, while allowing for eventual breakdown in the septic or sewer systems.

The addition of both the fiber-flexibilizing compositions and fugitive wet strength to the same tissue structure are competing needs. The fiber-flexibilizing compositions typically require water-holding media or compounds that have chemical behavior characteristics of water or compounds that require large amounts of water to be transported to the paper structure. At the same time, the fugitive wet strength begins to decay in contact with such media suited for the fiber-flexibilizing compositions.

Accordingly, there is a need for materials for economically softening paper structures having fugitive wet strength without unduly degrading dry strength, including maintaining surface integrity, i.e. low lint.

SUMMARY OF THE INVENTION

The present invention is directed to a tissue product comprising cellulosic fibers and having at least about 10% of fugitive wet strength and at least about 3% of a fiber-flexibilizing composition. More specifically, the tissue product of the present invention can have at least about 25% of the fugitive wet strength. The fugitive wet strength can be generated by adding a binder that promotes acid-catalyzed formation of hemiacetal functional inter-fiber cross-links. The fiber-flexibilizing composition can comprise either a humectant or a plasticizer. The humectant can be selected from the group consisting of calcium chloride; lactic acid and its salts, high fructose corn syrup, glycerol, triacetin, sorbitol, maltitol, mannitol, propylene glycol, and any combination thereof. The plasticizer can be selected from the group consisting of urea, alkyloxylated glycols, dextrose, sucrose, ethylene carbonate, propylene carbonate, and any combination thereof.

The tissue product can comprise a single-ply structure or a multi-ply structure. The tissue product can comprise a foreshortened, for example creped, tissue. Alternatively, the product can be uncreped. The tissue web can be made by any process known in the art, including, without limitation, a conventional papermaking process and a through-air-drying papermaking process.

The tissue product can comprise a differential-density paper comprising a plurality of high-density micro-regions and a plurality of low-density micro-regions. In the latter instance, the tissue product's plurality of high-density micro-regions can comprise a substantially continuous network, a substantially semi-continuous pattern, or a pattern of discrete areas, while the plurality of low-density micro-regions can comprise, correspondingly, a pattern of discrete fibrous pillows encompassed by the network region, a substantially semi-continuous pattern, or a substantially continuous areas.

A process for making the tissue product of the present invention comprises the steps of providing a plurality of cellulosic fibers comprising fugitive wet strength agent; forming a web of the cellulosic fibers; heating the web to a temperature of at least about 40° C. and a moisture content of less than about 5%; and depositing a fiber-flexibilizing composition to the surface of the web.

The step of forming a web of the cellulosic fibers can comprise the steps of providing a forming belt; depositing the plurality of cellulosic fibers comprising fugitive wet strength agent onto the forming belt and forming an embryonic web of the cellulosic fibers on the forming belt; providing a fluid-permeable macroscopically monoplanar molding belt having a web-side, a backside, opposite to the web-side, and a plurality of deflection conduits extending from the web-side to the backside and structured to receive portions of the cellulosic fibers therein; transferring the embryonic web from the forming belt to the web-side of the molding belt; deflecting portions of the embryonic web into the deflection conduits of the molding belt; impressing the embryonic web against the web-side of the molding belt; and drying the embryonic web. The step of deflecting the fibers into the deflection conduits of the molding belt can comprise applying a fluid pressure differential to the plurality of fibers disposed on the molding belt.

The steps of impressing the embryonic web and drying the embryonic web can comprise pressing the embryonic web between the molding belt and a surface of a drying drum. The step of depositing a fiber-flexibilizing composition to the surface of the web can comprise spraying the fiber-flexibilizing composition onto the surface of the web, printing fiber-flexibilizing composition onto the surface of the web, extruding fiber-flexibilizing composition to the surface of the web, or any combination thereof.

DETAILED DESCRIPTION OF THE INVENTION

Figure 1:
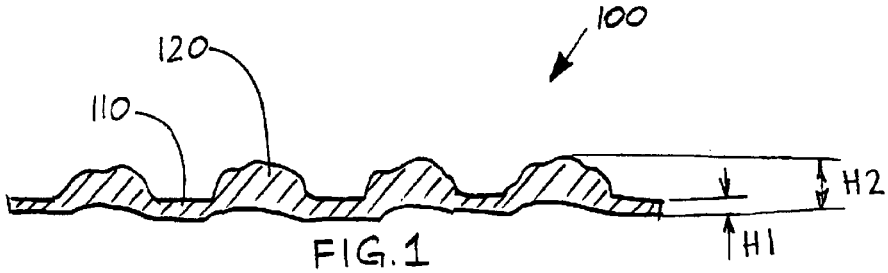
FIG. 1 is an elevated schematic partial cross-section of an embodiment of the product of the present invention.

Briefly, the present invention provides a tissue web having fugitive wet strength properties and a fiber-flexibilizing composition applied to one or both of its surfaces.

Surprisingly, it has been found that tissue paper having fugitive wet strength can be treated with hygroscopic or similar-acting substances that either contain water as an essential component of their equilibrium state or require water as deposition vehicle, without significantly degrading the tissue's fugitive wet strength characteristics. Importantly, it has been found that high levels of fiber-flexibilizing compositions may be added yielding high levels of bulk softness of the tissue paper while the paper web retains a high amount of its strength, has fugitive wet strength, and is surprisingly low in lint levels.

Without being bound by theory, applicants believe that the fiber-flexibilizing compositions, when applied to the dry paper web, are absorbed into the fiber interior sufficiently fast so that the fugitive wet strength does not significantly decay as it could be expected. Thus, the web retains its fugitive wet strength while acquiring the benefits of a dry-web application of the fiber-flexibilizing composition. These advantages include (1) reduced drying load compared to a wet end or wet web application and (2) lower lint levels. Again, without being bound by theory, applicants believe that the dry-web application of the fiber-flexibilizing composition creates the opportunity for the additives to be absorbed into the fiber to a degree sufficient to allow preserving a measure of the wet strength mechanism without becoming so absorbed as to have a significant effect on the fiber surface properties which affect the "lint" characteristics.

The fiber-flexibilizing composition can beneficially be applied to a hot tissue web. As used herein, the term "hot tissue web" refers to a tissue web that has an elevated temperature relative to room temperature. Specifically, the elevated temperature of the web is at least about 43° C., more specifically at least about 54° C., and even more specifically at least about 65° C. The hot web has a low equilibrium moisture content that facilitates adding the composition at the highest levels requiring minimal re-drying of the web and in some instances no re-drying at all. Applicants have found that the levels of up to about 30% of some fiber-flexibilizing compositions can be added to the hot tissue web at the dry end of the papermaking machine without the necessity for re-drying of the web.

The moisture content of a tissue web is related to the temperature of the web and the relative humidity of the surrounding environment. As used herein, the term "overdried tissue web" refers to a tissue web that is dried to a moisture content less than its equilibrium moisture content at standard test conditions of 23° C. and 50% relative humidity. The equilibrium moisture content of a tissue web placed in the standard testing conditions is approximately 7%. A tissue web of the present invention can be overdried by raising the drying temperature of drying means known in the art, such as, for example, a Yankee dryer or through-air drying. An overdried tissue web can have a moisture content of less than about 7%, more specifically less than about 6%, and even more specifically less than about 3%.

The tissue product of the present invention can be foreshortened, creped for example, or—alternatively—be non-foreshortened. When the tissue is dried and creped the moisture content in the sheet is generally less than 3%. After manufacturing, the paper normally absorbs water from the atmosphere.

It is beneficial if the fiber-flexibilizing composition of the present invention is applied to an overdried tissue web shortly after the web is separated from a drying means and before it is wound onto a parent roll. Alternatively or additionally, the composition can be applied to a dry tissue web having a somewhat higher moisture content, provided it is maintained below about 20% moisture, for example, a web in moisture equilibrium with its environment as the web is unwound from a parent roll as, for example, during an off-line converting operation.

The present invention is applicable to any tissue paper in general, including but not limited to conventionally felt-pressed tissue, pattern-densified tissue, and high-bulk, uncompacted tissue. The tissue may be of a homogenous or multi-layered construction; and tissue products made therefrom may be of a single-ply or multi-ply construction. The tissue paper can have a basis weight of between about 10 gram per square meter ($g/m^2$) and about 120 $g/m^2$, and overall density of about 0.60 gram per cubic centimeter (g/cc) or less. More specifically, the basis weight can be below about 35 $g/m^2$; and the density can be below about 0.30 g/cc. More specifically, the density is between about 0.04 g/cc and about 0.20 g/cc. Density values as described herein are calculated using thickness measurement made under a load of 95 $g/cm^2$.

The present invention contemplates the use of a variety of fibers papermaking fibers, such as, for example, synthetic fibers, or any other suitable fibers, and any combination thereof. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The particular species of tree from which the fibers are derived is immaterial. The hardwood and softwood fibers can be blended, or alternatively, can be deposited in layers to provide a stratified web. U.S. Pat. Nos. 4,300,981 and 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

In addition to the various wood pulp fibers, other cellulosic fibers such as cotton linters, rayon, and bagasse can be used in this invention. Synthetic fibers, such as polymeric fibers, can also be used. Elastomeric polymers, polypropylene, polyethylene, polyester, polyolefin, and nylon, can be used. The polymeric fibers can be produced by spunbond processes, meltblown processes, and other suitable methods known in the art.

The embryonic web can be typically prepared from an aqueous dispersion of papermaking fibers, though dispersions in liquids other than water can be used. The fibers are dispersed in the carrier liquid to have a consistency of from about 0.1 to about 0.3 percent. It is believed that the present invention can also be applicable to moist forming operations where the fibers are dispersed in a carrier liquid to have a consistency less than about 50 percent. It is further believed that the present invention can be applicable to airlaid structures, including air-laid webs comprising pulp fibers, synthetic fibers, and mixtures thereof.

Conventionally pressed tissue paper and methods for making such paper are known in the art and therefore are not illustrated herein. Such paper is typically made by depositing a papermaking furnish on a foraminous forming wire, such as, for example, a Fourdrinier wire. Once the furnish is deposited on the forming wire, it is referred to as a web (or embryonic web). Water can be removed from the web by vacuum, mechanical pressing, drying at elevated temperature or any combination thereof. The particular techniques and typical equipment for making webs are well known to those skilled in the art. In a typical process, a low-consistency pulp furnish is provided in a pressurized headbox. The headbox has an opening for delivering a thin deposit of pulp furnish onto the forming wire to form a wet (embryonic) web. The web is then typically dewatered to a fiber consistency of between about 7% and about 45% (total web weight basis) by vacuum dewatering and further dried by pressing operations wherein the web is subjected to pressure developed by opposing mechanical members, for example, cylindrical rolls. The dewatered web can be further pressed and dried by a stream drum apparatus known in the art as a Yankee dryer. Pressure can be developed at the Yankee dryer by mechanical means such as an opposing cylindrical drum pressing against the web. Multiple Yankee dryer drums may be employed, whereby additional pressing is optionally incurred between the drums. The tissue structures that are formed are referred to hereinafter as conventional tissue structures. Such sheets are considered to be compacted, since the web is subjected to substantial overall mechanical compression forces while the fibers are moist and are then dried while in a compressed state. The resulting structure is strong and generally of singular density, but typically very low in bulk, absorbency and in softness.

Uncompacted, non pattern-densified tissue paper structures are described in U.S. Pat. Nos. 3,812,000 and 4,208,459 the disclosures of which are incorporated herein by reference. In general, uncompacted, non pattern-densified tissue paper structures are prepared by depositing a papermaking furnish on a foraminous forming wire such as a Fourdrinier wire to form a wet web, draining the web and removing additional water without mechanical compression until the web has a fiber consistency of at least 80%, and creping the web. Water is removed from the web by vacuum dewatering and thermal drying. The resulting structure is a soft but weak high-bulk sheet of relatively uncompacted fibers. Bonding material can be beneficially applied to portions of the web prior to creping.

Pattern-densified tissue is characterized by having a combination of a plurality of relatively high-density regions and a plurality of relatively low-density regions, typically distributed throughout the sheet in a non-random predetermined pattern. Generally, the low-density regions comprise relatively high-bulk portions (conventionally called "pillows") of the web, while the high-density regions comprise relatively low-bulk portions (conventionally called "knuckles") of the web. The high-density regions may be discretely spaced within the low-density regions, or may be interconnected, either fully (forming a so-called continuous network) or partially (forming a so-called semi-continuous pattern). Processes for making pattern-densified tissue webs are disclosed in U.S. Pat. Nos. 3,301,746; 3,974,025; 4,191,609; and 4,637,859, the disclosures of which are incorporated herein by reference.

Figure 4:
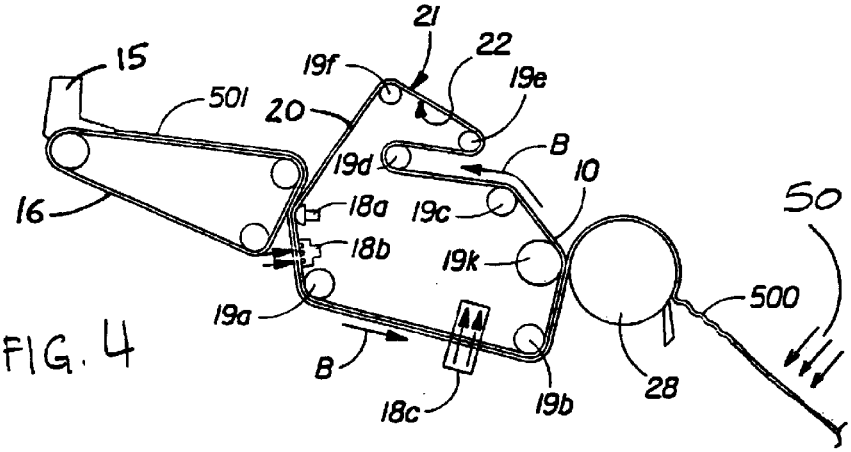
FIG. 4 is a schematic side view of one embodiment of the process of the present invention.

One exemplary embodiment of a through-air-drying process, schematically shown in FIG. 4, for producing a pattern-densified tissue comprises the following steps. First, a plurality of fibers 501, comprising fugitive wet strength composition, is provided and is deposited on a molding belt 20 of the present invention. The plurality of fibers can also be supplied in the form of a moistened fibrous web (not shown). A cellulosic furnish 501 from a head box 15 can be deposited onto a forming wire 16, such as, for example, a foraminous Fourdrinier wire. The fiber-flexibilizing composition can be added into the head box 15, as part of the cellulosic furnish, and mixed therewith. Alternatively, the composition can be added to an embryonic web being formed on the forming wire 16. The embryonic web can be dewatered and transferred to a fluid-permeable molding belt 20, which is shown in FIG. 4 in the form of an endless belt traveling about rolls 19*a*, 19*b*, 19*k*, 19*c*, 19*d*, 19*e*, and 19*f* in the direction schematically indicated by the directional arrow "B." The molding belt 20 is macroscopically monoplanar, which means that the belt as a whole, when is disposed on a planar surface, forms a substantially monoplanar surface. The molding belt has a deflection portion therein, i.e., a portion onto which the fibers of the embryonic web deflect under the influence of a fluid pressure differential and/or mechanical pressure.

The embryonic web comprising fibers 501 can be transferred from a forming wire 16 to the molding belt 20 by a vacuum pick-up shoe 18*a*. Alternatively or additionally, a plurality of fibers, or fibrous slurry, can be deposited to the molding belt 20 directly (not shown) from a headbox or otherwise.

Figure 5:
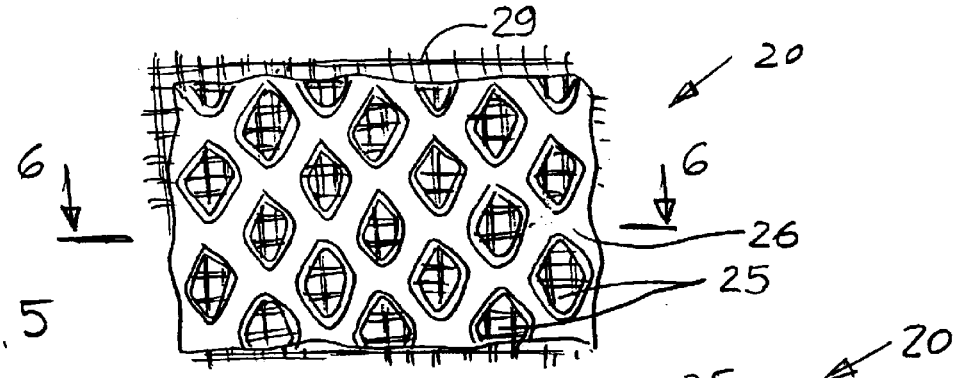
FIG. 5 is a schematic plan view of one embodiment of a molding belt that can be used to produce the tissue of the present invention, wherein a resinous element of the belt comprises a substantially continuous framework.
Figure 6:
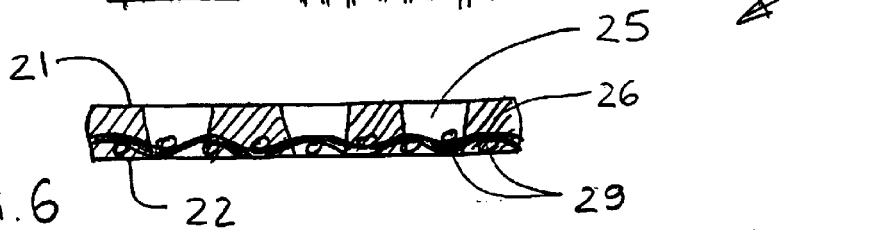
FIG. 6 is a schematic cross-section of the belt shown in FIG. 5, taken along lines 6—6.
Figure 7:
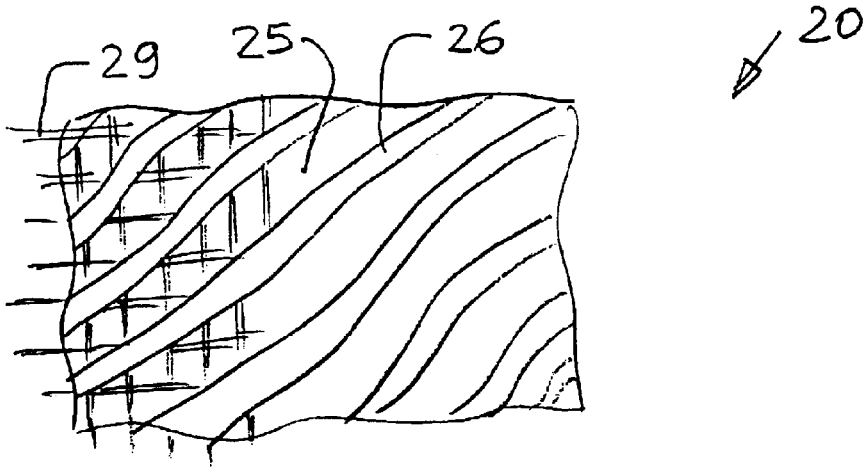
FIG. 7 is a schematic plan view of another embodiment of a molding belt that can be used to produce the tissue of the present invention wherein a resinous element of the belt comprises a substantially semi-continuous pattern.
Figure 8:
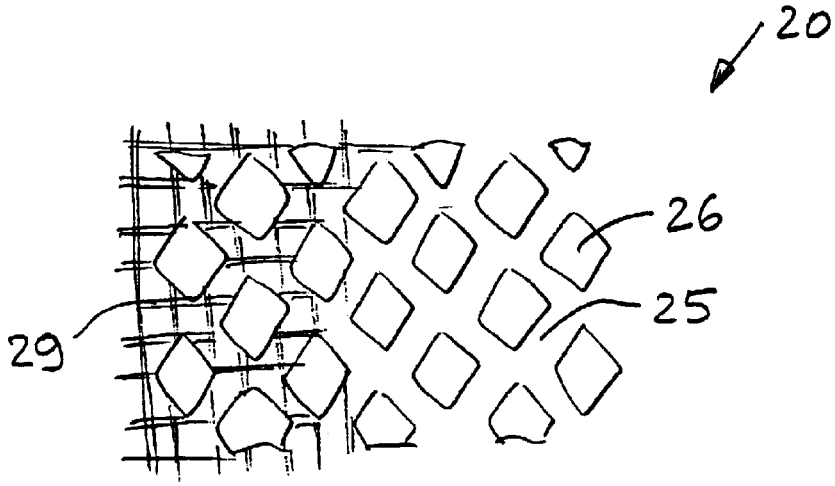
FIG. 8 is a schematic plan view of another embodiment of a molding belt that can be used to produce the tissue of the present invention wherein a resinous element of the belt comprises a plurality of discrete elements.

When on the molding belt 20, a portion of the fibers 501 is deflected into the deflection portion of the molding belt 20 such as to cause some of the deflected fibers or portions thereof to be disposed within deflection conduits 25 (FIGS. 5–8) of the molding belt 20. The molding belt 20 shown in FIGS. 5–8 has a web-side 21 and a backside 22, and comprises a reinforcing element 29 (typically formed by interwoven yarns) and a resinous element 26 joined thereto in a non-random pattern. The papermaking fibers are deposited onto the web-side 21 of the belt 20. The backside 21 of the belt 20 is opposite to the web-side 21 and contacts papermaking equipment during the process. The pattern of the resinous element 26 can be substantially continuous (as shown in FIG. 5), substantially semi-continuous (FIG. 7), or substantially discrete (FIG. 8). Therefore, the pattern of the deflection conduits can correspondingly be substantially discrete (FIG. 5), substantially semi-continuous (FIG. 7), and substantially continuous (FIG. 8). Through-air drying molding belts comprising a reinforcing element and a resinous framework, and/or fibrous webs made using these belts are well known in the art and described, for example, in the following commonly assigned U.S. Patents, the disclosures of which are incorporated herein by reference for the purpose of teaching one skilled in the art various constructions of the molding belts and the fibrous structures made using the belts: U.S. Pat. Nos. 4,514,345, 4,528,239, 4,529,480; 4,637,859; 5,098,522; 5,245,025; 5,260,171; 5,275,700; 5,328,565; 5,334,289; 5,431,786; 5,496,624; 5,500,277; 5,514,523; 5,527,428; 5,554,467; 5,566,724; 5,624,790; 5,628,876; 5,679,222; 5,714,041; 5,900,122; and 5,948,210.

Depending on the process, mechanical pressure, as well as fluid pressure differential, alone or in combination, can be utilized to deflect fibers or their portions into the deflection conduits 25 of the molding belt 20. For example, in a through-air drying process shown in FIG. 4, a vacuum apparatus 18*b*, applies a fluid pressure differential to the embryonic web disposed on the molding belt 20, thereby deflecting fibers or their portions into the deflection conduits 25 of the molding belt 20. The process of deflection may be continued as another vacuum apparatus 18*c* applies additional vacuum pressure to even further deflect the fibers into the deflection conduits 25 of the molding belt 20. A portion of the deflected fibers is disposed in the molding belt's deflection conduits extending between the web-side 21 and the backside 22 of the belt 20.

The step of deflecting the fibers into the deflection conduits of the molding belt 20 may be beneficially accomplished by using a process disclosed in commonly assigned U.S. Pat. No. 5,893,965, the disclosure of which is incorporated herein by reference. According to this process, a web disposed on the molding belt is overlaid with a flexible sheet of material (not shown) such that the web is disposed intermediate the sheet of material and the molding belt. The sheet of material has air permeability less than that of the molding belt. In one embodiment, the sheet of material is air-impermeable. An application of a fluid pressure differential to the sheet of material causes deflection of at least a portion of the sheet of material towards the molding belt and thus deflection of at least a portion of the web into the conduits of the papermaking belt. A partly-formed fibrous structure associated with the molding belt 20 can be separated from the molding belt, to form the fibrous structure 500 of the present invention.

Figure 2:
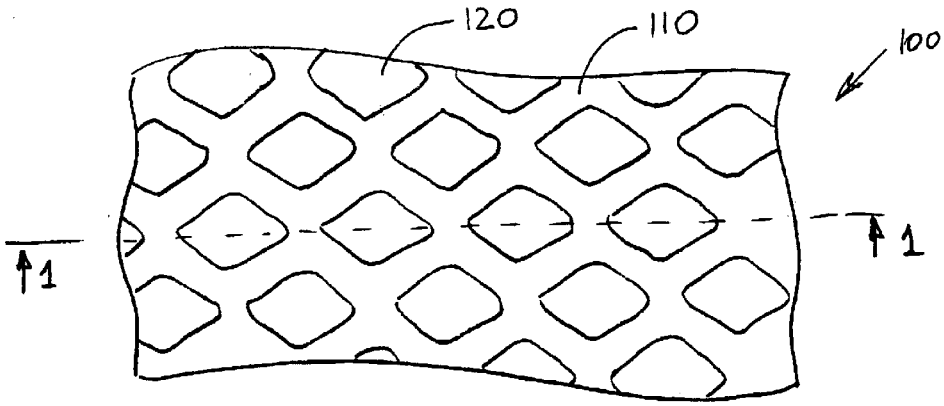
FIG. 2 is a schematic plan view of the product shown in FIG. 1.
Figure 3:
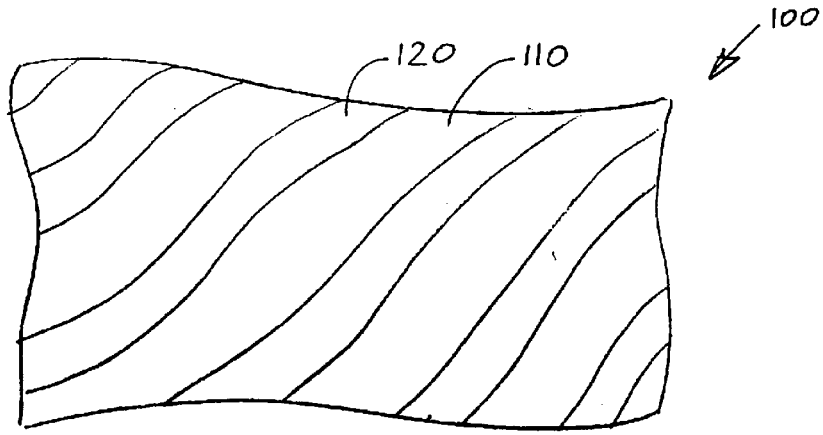
FIG. 3 is a schematic plan view of another embodiment of the product of the present invention.

The process may further comprise a step of impressing the molding belt 20 having the web therein against a pressing surface, such as, for example, a surface of a Yankee drying drum 28, thereby densifying selected portions of the web. Then, based on the density, the resulting fibrous structure may comprise at least two pluralities of micro-regions: a first plurality of micro-regions 110 (FIGS. 1–3) having a relatively high density, and a second plurality of micro-regions 120 (FIGS. 1–3) comprising fibrous pillows, extending from the first plurality of micro-regions and having a relatively low density. In some embodiments, the resulting web may have a third plurality of micro-regions (not shown) adjacent to at least one of the first plurality of micro-regions and the second plurality of micro-regions, and having an intermediate density relative to the relatively high density of the first plurality of micro-regions and the relatively low density of the second plurality of micro-regions.

The fiber-flexibilizing composition of the present invention can be applied to a foreshortened as well as non-foreshortened tissue paper. Foreshortening may comprise creping and/or micro-contraction. As used herein, foreshortening refers to the reduction in length of a web which occurs when energy is applied to the web in such a way that the length of the web is reduced and the fibers in the web are rearranged with an accompanying disruption of some of the fiber-fiber bonds. Foreshortening can be accomplished in any of several well-known ways. The most common and preferred method is creping. In the creping operation, the web is adhered to a surface and then removed from that surface with a doctor blade. The surface to which the web is usually adhered also functions as a drying surface, typically the surface of the Yankee dryer drum. Generally, only the first portion of the web which has been associated with the web-side surface of the drying belt is directly adhered to the surface of Yankee dryer drum. The pattern of the first portion of the web and its orientation relative to the doctor blade 16 will in major part dictate the extent and the character of the creping imparted to a finished paper web. The web may also be wet-microcontracted, as disclosed in the commonly assigned U.S. Pat. No. 4,440,597 incorporated herein by reference.

Uncreped tissue paper, a term as used herein, refers to tissue paper that is dried entirely by non-compressive means. To produce uncreped tissue paper webs, an embryonic web can be transferred from the foraminous forming carrier upon which it is laid, to a slower moving, high fiber support transfer fabric carrier. The web is then transferred to a drying fabric upon which it is dried to a final dryness.

The techniques to produce uncreped tissue are known. The examples include: European Patent Application 0 677 612 B1, granted Sep. 13, 2000, European Patent Application 0 617 164 B1, granted Aug. 13, 1997, and U.S. Pat. No. 5,656,132. The disclosures of the documents mentioned above are incorporated herein by reference for the purpose of showing some examples of various representative uncreped paper structures and processes for making same.

The present invention applies to tissue product having fugitive wet strength property, i.e., the wet strength, characterized by a decay of part or all of the initial strength upon standing in presence of water. Specifically, the tissue product of the present invention has at least about 0.5 g/in (19.69 g/m) for each g/m2 of basis weight of initial wet tensile, i.e. 19.69 m wet breaking length. More specifically, the initial wet tensile will be at least about 40 m wet breaking length and even more specifically, the initial wet tensile will be at least about 80 m wet breaking length. The fugitive wet strength is defined herein as the percentage of a wet tensile strength loss upon standing wet for 30 min. The tissue product of the present invention has at least about 10% fugitive wet strength, more specifically at least about 30% and still more specifically at least about 60%.

One method of delivering fugitive wet strength is to provide for the formation of acidcatalyzed hemiacetal formation through the introduction of ketone or, more specifically aldehyde functional groups on the papermaking fibers or in a binder additive for the papermaking fibers. One binder material that have been found particularly useful for imparting this form of fugitive wet strength is Parez 750® offered by Cytec of Stamford, Conn.

Other additives can also be used to augment this wet strength mechanism. This technique for delivering fugitive wet strength is well known in the art. Exemplary art, incorporated herein by reference for the purpose of showing methods of delivering the fugitive wet strength to the web, includes the following U.S. Pat. Nos. 5,690,790; 5,656,746; 5,723,022; 4,981,557; 5,008,344; 5,085,736i; 5,760,212; 4,605,702; 6,228,126; 4,079,043; 4,035,229; 4,079,044; and 6,127,593.

While the hemiacetal formation mechanism is one suitable technique for generating temporary wet strength, there are other methods, such as providing the sheet with a binder mechanism which is more active in the dry or slightly wet condition than in the condition of high dilution as would be experienced in the toilet bowl or in the subsequent sewer and septic system. Such methods have been primarily directed at web products which are to be delivered in a slightly moist or wet condition, then will be disposed under situation of high dilution. The following references are incorporated herein by reference for the purpose of showing exemplary systems to accomplish this, and those skilled in the art will readily recognize that they can be applied to the webs of the present invention which will be supplied generally at lower moisture content than those described therewithin: U.S. Pat. Nos. 4,537,807; 4,419,403; 4,309,469; and 4,362,781.

The fiber-flexibilizing composition suitable for the tissue product of the present invention can be selected from a group consisting of humectants and plasticizers. The group of humectants which can be applied to the tissue of the present invention can retain water by a variety of mechanisms. Any material having acceptable moisture retaining property is suitable. These may include, but are not limited to, hydroxyl-bearing organic compounds such as, for example, glycerol, pentaerythritol, sugars (including certain monosaccharides, disaccharides, and higher oligmers such as present in starch hydrosolates such as high fructose corn syrup), sugar alcohols such as sorbitol and mannitol, and deliquescent salts such as calcium chloride and sodium lactate. The humectant can have a vapor pressure of less than 0.1 mm at 70° F. The humectant can have a weight average molecular weight of less than about 1000.

If we consider a simple molecular weight distribution which represents the weight fraction ($w_i$) of molecules having relative molecular mass ($M_i$), it is possible to define several useful average values. Averaging carried out on the basis of the number of molecules ($N_i$) of a particular size ($M_i$) gives the Number Average Molecular Weight $$\overline{M}_n = \frac{\sum N_i M_i}{\sum Ni}$$

One of the consequences of this definition is that the Number Average Molecular Weight in grams contains Avogadro's Number of molecules. This definition of molecular weight is consistent with that of monodisperse molecular species, i.e. molecules having the same molecular weight. Of more significance is the recognition that if the number of molecules in a given mass of a polydisperse polymer can be determined in some way then $\overline{M}_n$, can be calculated readily. This is the basis of colligative property measurements.

Averaging on the basis of the weight fractions ($W_i$) of molecules of a given mass ($M_i$) leads to the definition of Weight Average Molecular Weights $$\overline{M}_w = \frac{\sum W_i N_i}{\sum W_i} = \frac{\sum N_i M_i^2}{\sum N_i M_i}$$

$\overline{M}_w$ is a more useful means for expressing polymer molecular weights than $\overline{M}_n$ since it reflects more accurately such properties as melt or solution viscosity and mechanical properties of polymers and is therefore used in the present invention.

The term "plasticizer" as used herein refers to a material capable of being absorbed into the fiber and imparting a greater flexibility thereto. The following description of plasticizers refers to specific criteria. Any compound having a low molecular weight, i.e. weight average molecular weight that is less than about 1000, bearing hydrogen atoms bonded to oxygen or nitrogen is classified as a plasticizer, provided the total mass of such hydrogen atoms comprise at least about 1% by weight of said plasticizer and said plasticizer has a vapor pressure less than about 0.1 mm Hg at 70° F. Examples include urea and low-water-imbibing mono, di-, and oligo-saccharides including dextrose and sucrose. Also included as plasticizers are ethyloxylated and propyloxylated compounds provided the alkyloxylated portion of the plasticizing molecule is at least 25% by weight and the molecular weight 1000 ceiling and vapor pressure less than about 0.1 mm Hg at 70° F. are also met. Polyethylene glycol and polypropylene glycol are examples. Further plasticizers include homologous series of alkyl carbonates with molecular weight less than about 1000 and vapor pressure less than 0.1 mm at 70° F., particularly including ethylene carbonate and propylene carbonate. Other examples of potential plasticizers include urea derivatives, certain lower-moisture-retaining sugars such as dextrose and sucrose, anhydrides of sugar alcohols such as sorbitan; animal proteins such as gelatin, vegetable proteins such as soybean, cottonseed, and sunflower protein, alkyl glycols and alkoxylated glycol compounds including polyethylene glycol, polypropylene glycol and copolymers such as polyoxyethylene/polyoxypropylene having the following structure:

$$HO—(CH_2—CH_2—O)_x(CHCH_3—CH_2O)_y—(CH_2CH_2—O)_z—OH$$

wherein x has a value ranging from about 2 to about 40, y has a value ranging from about 10 to about 50, and z has a value ranging from about 2 to about 40, and more specifically x and z have the same value. These copolymers are available as Pluronic® from BASF Corp., Parsippany, N.J.

The amount of the fiber-flexibilizing composition applied to the web is greater than about 3%, more specifically greater than about 5% and even more specifically greater than about 10%. The amount of fiber-flexibilizing composition should be less than about 50%, more specifically less than about 30% and even more specifically less than about 20%.

Other, optional, materials can be added to the aqueous papermaking furnish, the embryonic web, or to the finished web to impart other desirable characteristics to the product or improve the papermaking process so long as they are compatible with the chemistry of the fiber-flexibilizing composition and do not significantly and adversely affect the softness or strength character of the present invention. The following materials are expressly included, but their inclusion is not offered to be all-inclusive. Other materials can be included as well so long as they do not interfere or counteract the advantages of the present invention. It is common to add a cationic charge biasing species to the papermaking process to control the zeta potential of the aqueous papermaking furnish as it is delivered to the papermaking process. These materials are used because most of the solids in nature have negative surface charges, including the surfaces of cellulosic fibers and fines and most inorganic fillers. One traditionally used cationic charge biasing species is alum. Also, charge biasing can be done by the use of relatively low molecular weight cationic synthetic polymers, specifically those having a molecular weight of no higher than about 500,000 and more specifically no higher than about 200,000, or even no higher than about 100,000. The charge densities of such low molecular weight cationic synthetic polymers are relatively high. These charge densities range from about 4 to about 8 equivalents of cationic nitrogen per kilogram of polymer. An exemplary material is Alcofix 159®, a product of Ciba Geigy, Inc. headquarted in Basel, Switzerland. The use of such materials is expressly included in the scope of the present invention.

The use of high surface area, high anionic charge microparticles for the purposes of improving formation, drainage, strength, and retention is taught in the art. The disclosure of U.S. Pat. No. 5,221,435 is incorporated herein by reference. Common materials for this purpose include, without limitation, silica colloid, or bentonite clay.

If some measure of permanent wet strength is desired, the group of chemicals: including polyamide-epichlorohydrin, polyacrylamides, styrene-butadiene lattices; insolubilized polyvinyl alcohol; urea-formaldehyde; polyethyleneimine; chitosan polymers and mixtures thereof can be added to the papermaking furnish or to the embryonic web. Such resins include, without limitation, cationic wet strength resins, such as polyamide-epichlorohydrin resins. Suitable types of such resins are described in U.S. Pat. Nos. 3,700,623 and 3,772,076, the disclosure of both being hereby incorporated by reference. One commercial source of useful polyamide-epichlorohydrin resins is Hercules, Inc. of Wilmington, Del., which markets such resin under the mark Kymene 557H®.

If enhanced absorbency is needed, surfactants may be used to treat the tissue paper webs of the present invention. The level of surfactant content, if used, can be from about 0.01% to about 2.0% by weight, based on the dry fiber weight of the tissue web. The surfactants can beneficially have alkyl chains with eight or more carbon atoms. Exemplary anionic surfactants include linear alkyl sulfonates and alkylbenzene sulfonates. Exemplary nonionic surfactants include alkylglycosides including alkylglycoside esters such as Crodesta SL-40® which is available from Croda, Inc. (New York, N.Y.); alkylglycoside ethers as described in U.S. Pat. No. 4,011,389, issued to Langdon, et al. on Mar. 8, 1977; and alkylpolyethoxylated esters such as Pegosperse 200 ML available from Glyco Chemicals, Inc. (Greenwich, Conn.) and IGEPAL RC-520® available from Rhone Poulenc Corporation (Cranbury, N.J.). Alternatively, cationic softener active ingredients with a high degree of unsaturated (mono and/or poly) and/or branched chain alkyl groups can greatly enhance absorbency.

The present invention also expressly includes variations in which chemical softening compositions can be added as a part of the papermaking process as part of the furnish preparation or subsequent to web formation. For example, chemical softening compositions may be included by wet end addition. Suitable chemical softening compositions comprise quaternary ammonium compounds including, but not limited to, the well-known dialkyldimethylammonium salts (e.g., ditallowdimethylammonium chloride, ditallowdimethylammonium methyl sulfate, di(hydrogenated tallow) dimethyl ammonium chloride, etc.). Particularly suitable variants of these softening compositions include mono or diester variations of the before mentioned dialkyldimethylammonium salts and ester quaternaries made from the reaction of fatty acid and either methyl diethanol amine and/or triethanol amine, followed by quaternization with methyl chloride or dimethyl sulfate. Another class of papermaking-added chemical softening compositions comprises the well-known organo-reactive polydimethyl siloxane ingredients, including amino functional polydimethyl siloxane. These may be wet end-added or surface-applied. Other applicable art in the field of surface-applied chemical softeners incorporated herein by reference includes U.S. Pat. Nos. 6,179,961; 5,814,188; 6,162,329, and the application WO0022231A1 in the names of Vinson et. al. Filler materials may also be incorporated into the tissue of the present invention. U.S. Pat. No. 5,611,890, incorporated herein by reference, discloses filled tissue paper products that are acceptable as substrates for the present invention. The above description of optional chemical additives is intended to be merely exemplary in nature, and is not meant to limit the scope of the invention.

According to the present invention, the fiber-flexibilizing composition can be applied to a paper web while it is in a dry condition. The term "dry condition" refers to the state, and "dry paper web" refers to the web itself, both defined herein as having a low moisture content of less than about 20%, and more specifically less than about 10%, and even more specifically less than about 3%. Therefore "dry tissue web" as used herein includes both webs which are dried to a moisture content less than the equilibrium moisture content thereof (so-called "overdried webs") and webs which have a low level of moisture remaining, specifically up as much as about 20% moisture.

In one embodiment, the fiber-flexibilizing composition of the current invention may be applied after the tissue web has been dried and creped, and, more specifically, while the web is still at an elevated temperature, FIG. 4, reference numeral 50. The softening composition can be applied to the dried and creped web before the web is wound onto the parent roll. Thus, the softening composition can be applied to a hot, overdried web after the web has been creped and after the web has passed through the calender rolls (not shown) which control the caliper. While the composition can be applied to either side or both sides of the tissue, beneficially the composition can be applied only to that side of the web that does not contact any rolls between the calender rolls and the winder.

The fiber-flexibilizing composition can be beneficially applied to the web in a uniform fashion so that substantially the entire web surface benefits from the effect of the composition. Following application to the hot web, a minimal portion of the volatile components of the composition evaporates. Since the composition comprises maximum content of non-volatile agents, any water present in the composition becomes part of the new equilibrium moisture content of the tissue treated with the composition.

One method of macroscopically uniformly applying the softening composition to the web is spraying. Spraying has been found to be economical, and can be accurately controlled with respect to quantity and distribution of the composition. The dispersed composition can be applied onto the dried, creped tissue web before the web is wound into the parent roll. Those skilled in the art will recognize that spraying should be controlled to achieve a maximum possible distribution, i.e. small droplet size, limited by transfer efficiency. One acceptable spraying system uses ITW Dynatec UFD nozzles, offered by Illinois Tool Works of Glenview, Ill. One suitable nozzle model has five fluid orifices, each 0.46 mm×0.51 mm in size. The center of the 5 fluid orifices is oriented directly vertical to the path of the tissue paper web, while the outer orifices are angled at 15 degrees relative to vertical, and the two intermediate nozzles are angled at 7.5 degrees relative to vertical. Each fluid orifice has an associated air orifice situated on either side of it, for a total of 10 air orifices, each of 0.51 mm×0.51 mm size. The fluid orifice extends 0.5 cm beyond the lower surface of the nozzle. Nozzles are spaced about 5 cm apart and about 5 cm above the tissue paper web while it is being treated. Air pressure sufficient to create a uniformly atomized spray is used.

The following Example illustrates preparation of tissue paper according to the present invention. This example demonstrates the production of layered tissue paper webs comprising the fiber-flexibilizing composition according to the present invention. The composition is applied to one side of the web and the webs are combined into a two-ply bath tissue product. A pilot-scale Fourdrinier papermaking machine is used for the production of the tissue.

An aqueous slurry of NSK of about 3% consistency is made up using a conventional repulper and is passed through a stock pipe toward the headbox of the Fourdrinier.

In order to impart temporary wet strength to the finished product, a 1% dispersion of Parez 750® is prepared and is added to the NSK stock pipe at a rate sufficient to deliver 0.3% Parez 750® based on the dry weight of the NSK fibers. The absorption of the temporary wet strength resin is enhanced by passing the treated slurry through an in-line mixer.

An aqueous slurry of eucalyptus fibers of about 3% by weight is made up using a conventional repulper. The stock pipe carrying eucalyptus fibers is treated with a cationic starch, RediBOND 5320®, which is delivered as a 2% dispersion in water and at a rate of 0.15% based on the dry weight of starch and the finished dry weight of the resultant creped tissue product. Absorption of the cationic starch is improved by passing the resultant mixture through an in line mixer. In order to impart a temporary wet strength to the finished product and to reduce the dustiness or linting of the surface of the tissue paper, a 1% dispersion of Parez 750® is prepared and is added to the eucalyptus stock pipe at a rate sufficient to deliver 0.375% Parez 750® based on the dry weight of the eucalyptus fibers. The absorption of the temporary wet strength resin is enhanced by passing the treated slurry through an in-line mixer.

The NSK fibers are diluted with white water at the inlet of a fan pump to a consistency of about 0.15% based on the total weight of the NSK fiber slurry. The eucalyptus fibers, likewise, are diluted with white water at the inlet of a fan pump to a consistency of about 0.15% based on the total weight of the eucalyptus fiber slurry. The eucalyptus slurry and the NSK slurry are both directed to a layered headbox capable of maintaining the slurries as separate streams until they are deposited onto a forming fabric on the Fourdrinier.

The paper machine has a layered headbox having a top chamber, a center chamber, and a bottom chamber. The eucalyptus fiber slurry is pumped through the top and bottom headbox chambers and, simultaneously, the NSK fiber slurry is pumped through the center headbox chamber and delivered in superposed relation onto the Fourdrinier wire to form thereon a three-layer embryonic web, of which about 70% is made up of the eucalyptus fibers and 30% is made up of the NSK fibers. Dewatering occurs through the Fourdrinier wire and is assisted by a deflector and vacuum boxes. The Fourdrinier wire is of a 5-shed, satin weave configuration having 87 machine-direction and 76 cross-machine-direction monofilaments per inch, respectively.

The embryonic wet web is transferred from the Fourdrinier wire, at a fiber consistency of about 15% at the point of transfer, to a patterned drying fabric. The drying fabric is designed to yield a pattern densified tissue with discontinuous low-density deflected areas arranged within a continuous network of high density (knuckle) areas. This drying fabric is formed by casting an impervious resin surface onto a fiber mesh supporting fabric. The supporting fabric is a 45×52 filaments per inch, dual layer mesh. The thickness of the resin cast is about 10 mil above the supporting fabric. The knuckle area is about 40% and the open cells remain at a frequency of about 90 per square inch.

The embryonic wet web is transferred from the Fourdrinier wire, at a fiber consistency of about 15% at the point of transfer, to a patterned drying fabric. The drying fabric is designed to yield a pattern-densified tissue with discontinuous low-density deflected areas arranged within a continuous network of high density (knuckle) areas. This drying fabric is formed by casting an impervious resin surface onto a fiber mesh supporting fabric. The supporting fabric is a 45×52 filaments per inch, dual layer mesh. The thickness of the resin cast is about 10 mil above the supporting fabric. The knuckle area is about 40% and the open cells remain at a frequency of about 78 per square inch.

Further de-watering is accomplished by vacuum assisted drainage until the web has a fiber consistency of about 30%.

While remaining in contact with the patterned forming fabric, the patterned web is pre-dried by air blow-through pre-dryers to a fiber consistency of about 65% by weight. The semi-dry web is then transferred to the Yankee dryer and adhered to the surface of the Yankee dryer with a sprayed creping adhesive comprising a 0.125% aqueous solution of polyvinyl alcohol. The creping adhesive is delivered to the Yankee surface at a rate of 0.1% adhesive solids based on the dry weight of the web. The fiber consistency is increased to about 98% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. (177° C.) and a speed of about 800 fpm (feet per minute) (about 244 meters per minute). The paper is wound in a roll using a surface driven reel drum having a surface speed of about 656 feet per minute.

In a free span between the doctor blade and the reel in a position at which the web is essentially horizontal, an applicator comprising spaced apart ITW Dynatec UFD nozzles, made by Illinois Tool Works of Glenview, Ill., are positioned at a point terminating about 5 cm above the web. Each of the nozzles has five fluid orifices, 0.46 mm×0.51 mm in size. The center of the five fluid orifices is oriented directly vertical to the path of the tissue paper web, while the outer orifices are angled at 15 degrees relative to vertical, and the two intermediate nozzles are angled at 7.5 degrees relative to vertical. Each fluid orifice has an associated air orifice situated on either side of it, for a total of ten air orifices, each 0.51 mm×0.51 mm in size. The fluid orifice extends 0.5 cm beyond the lower surface of the nozzle. Nozzles are spaced about 5 cm apart and about 5 cm above the tissue web while it is being treated. Fluid is directed at the web in order to deliver about 15% by weight of the fiber-flexibilizing composition. About 15 psi of air pressure is sufficient to create a uniformly atomized spray.

The fiber-flexibilizing composition comprises material listed in the following TABLE:

| Trade Name | Chemical Name | % By WT | Supplier |
|---|---|---|---|
| Water | Water | 9.5% | |
| Urea Commercial | Urea | 23.7% | PCS Sales Inc. 5750 Old Orchard Rd, Suite 440 Skokie, IL 66007 (Distributed by Chemicals, Inc.) |
| Carbowax 600 | Polyethylene Glycol 600 | 2.3% | Dow Chemical Midland, MI |
| Calcium Chloride, 77% Flake | Calcium Chloride | 10% | General Chemical 90 East Halsey Road Parsippany, NJ 07054 (Distributed by Chemicals, Inc.) |
| Isoclear 55 | High Fructose Corn Syrup | 54.5% | Cargill Corn Milling 3201 Needmore Road Dayton, OH 45414 |

The paper is subsequently converted into a single-ply toilet tissue having a basis weight of about 34 g/m$^2$. It has about 15.8 g/cm of wet tensile and about 50% fugitive wet strength. It has about 15% of the fiber-flexibilizing composition and is a soft, low linting toilet tissue product.

Test Methods: Wet Tensile Strength and Fugitive Wet Strength

Wet Strength as defined herein is determined by the method described in ASTM D829-97 for Wet Tensile Breaking Strength of Paper and Paper Products, specifically by method 11.2 "Test Method B—Finch Procedure". The Fugitive Wet Strength is defined as the loss of wet tensile strength as measured immediately after saturation according to the before mentioned method, compared to the measurement made after standing for 30 minutes in the soaked condition in the Finch Cup prior to recording the tensile measurement. More particularly, Fugitive Wet Strength is defined as this loss as a percentage of the Wet Tensile Strength as made immediately after saturating.

What is claimed is:

1. A tissue product comprising cellulosic fiber and at least about 3% of a fiber-flexibilizing composition, the tissue product having at least 10% of fugitive wet strength, wherein the fugitive wet strength is generated by hemiacetal functional cross-links.

2. The tissue product of claim 1, wherein the tissue product has at least about 25% of fugitive wet strength.

3. The tissue product of claim 1, wherein the fiber-flexibilizing composition comprises a humectant.

4. The tissue product of claim 3, wherein the humectant is selected from the group consisting of calcium chloride, lactic acid and its salts, high fructose corn syrup, glycerol, triacetin, sorbitol, maltitol, mannitol, propylene glycol and any combination thereof.

5. The tissue product of claim 1, wherein the fiber-flexibilizing composition comprises a plasticizer.

6. The tissue product of claim 5, wherein the plasticizer is selected from the group consisting of urea, alkyloxylated glycols, dextrose, sucrose, ethylene carbonate, propylene carbonate, and any combination thereof.

7. The tissue product of claim 1, wherein the tissue product comprises a single-ply structure.

8. The tissue product of claim 1, wherein the tissue product comprises a multi-ply structure.

9. The tissue product of claim 1, wherein the tissue product comprises a foreshortened tissue.

10. The tissue product of claim 1, wherein the tissue product comprises a non-foreshortened tissue.

11. The tissue product of claim 1, wherein the tissue product comprises a differential-density paper comprising a plurality of high-density micro-regions and a plurality of low-density micro-regions.

12. The tissue product of claim 11, wherein the plurality of high-density micro-regions comprises a substantially continuous network, and the plurality of low-density micro-regions comprises a multiplicity of discrete fibrous pillows encompassed by the network region.

13. The tissue product of claim 11, wherein the plurality of high-density micro-regions comprises a substantially semi-continuous pattern, and the plurality of low-density micro-regions comprises a substantially semi-continuous pattern.

14. The tissue product of claim 11, wherein the plurality of high-density micro-regions comprises a plurality of discrete areas, and the plurality of low-density micro-regions comprises a substantially continuous area.

15. A process for making a tissue product comprising cellulosic fibers and having at least 10% of fugitive wet strength and at least about 3% of a fiber-flexibilizing composition, the process comprising the steps of:

a. providing a plurality of cellulosic fibers comprising a fugitive wet strength agent;

b. forming a web of the cellulosic fibers;

c. drying the web to a moisture content of less than about 5%; and d. depositing a fiber-flexibilizing composition to the surface of the web.

16. The process according to claim 15, wherein the step of forming a web of the cellulosic fibers comprises the steps of:

(a) providing a forming belt;

(b) depositing the plurality of cellulosic fibers comprising a fugitive wet strength agent onto the forming belt and forming an embryonic web of the cellulosic fibers on the forming belt;

(c) providing a macroscopically monoplanar molding belt having a web-side, a backside, opposite to the web-side, and a plurality of deflection conduits extending between the web-side and the backside and structured to receive portions of the cellulosic fibers therein;

(d) transferring the embryonic web from the forming belt to the web-side of the molding belt;

(e) deflecting portions of the embryonic web into the deflection conduits of the molding belt;

(f) impressing the embryonic web against the web-side of the molding belt; and (g) drying the embryonic web.

17. The process of claim 16, wherein the step of deflecting the fibers into the deflection conduits of the molding belt comprises applying a fluid pressure differential to the plurality of fibers disposed on the molding belt.

18. The process according to claim 16, wherein the steps of impressing the embryonic web and drying the embryonic web comprise pressing the embryonic web between the molding belt and a surface of a drying drum.

19. The process according to claim 15, wherein the step of depositing a fiber-flexibilizing composition to the surface of the web comprises spraying the fiber-flexibilizing composition, printing the fiber-flexibilizing composition, extruding the fiber-flexibilizing composition, or any combination thereof.

* * * * *